US010449597B2

(12) United States Patent
Köyer et al.

(10) Patent No.: US 10,449,597 B2
(45) Date of Patent: Oct. 22, 2019

(54) METHOD FOR THE SURFACE TREATMENT OF A WORKPIECE

(71) Applicant: THYSSENKRUPP STEEL EUROPE AG, Duisburg (DE)

(72) Inventors: Maria Köyer, Dortmund (DE); Janko Banik, Altena (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 0 days.

(21) Appl. No.: 14/610,233

(22) Filed: Jan. 30, 2015

(65) Prior Publication Data

US 2015/0209840 A1 Jul. 30, 2015

(30) Foreign Application Priority Data

Jan. 30, 2014 (DE) ..... 10 2014 101 159

(51) Int. Cl.

| | |
|---|---|
| ***C21D 9/00*** | (2006.01) |
| ***B21D 22/02*** | (2006.01) |
| ***B21D 22/20*** | (2006.01) |
| ***B21J 17/00*** | (2006.01) |
| ***C21D 1/673*** | (2006.01) |

(52) U.S. Cl.

CPC ..... *B21J 17/00* (2013.01); *B21D 22/022* (2013.01); *B21D 22/201* (2013.01); *B21D 22/208* (2013.01); *C21D 9/0056* (2013.01); *C21D 1/673* (2013.01)

(58) Field of Classification Search

CPC ..... B21J 17/00; B21D 22/208; B21D 22/022; B21D 22/201; C21D 9/0056; C21D 1/673

See application file for complete search history.

(56) References Cited

U.S. PATENT DOCUMENTS

| | | | | |
|---|---|---|---|---|
| 4,995,201 | A | 2/1991 | von Borcke et al. | |
| 5,758,530 | A * | 6/1998 | Yoshikawa | B21B 45/08 134/64 R |
| 6,742,236 | B1 * | 6/2004 | Dion | A61B 17/32002 29/434 |
| 7,399,535 | B2 * | 7/2008 | Yoshikawa | C23C 2/26 428/335 |
| 2005/0116397 | A1 | 6/2005 | Kimura et al. | |
| 2007/0113610 | A1 * | 5/2007 | Rittner | B21B 1/466 72/202 |

(Continued)

FOREIGN PATENT DOCUMENTS

| | | | |
|---|---|---|---|
| DE | 102006019544 | A1 | 6/2007 |
| DE | 102007012180 | B3 | 6/2008 |

(Continued)

OTHER PUBLICATIONS

English machine translation of WO 2012152508 A1.*
Machine Translation of WO 2013/156316, Translated Jan. 9, 2018, 6 Pages.*
Machine Translation of JP2012-025977, Akioka, Koji, Translated Aug. 15, 2018, 5 Pages.*

(Continued)

*Primary Examiner* — Gregory D Swiatocha
(74) *Attorney, Agent, or Firm* — Lathrop Gage L.L.P.

(57) ABSTRACT

A method for the surface treatment of a metal workpiece, in particular of a coated metal workpiece, for hot forming includes partially or completely heating the workpieces to a temperature of at least Ac1, cleaning at least one surface of the heated workpiece with at least one pressurized air jet, forming the heated and cleaned workpiece, and cooling down the formed workpiece.

16 Claims, 3 Drawing Sheets

(56) References Cited

U.S. PATENT DOCUMENTS

| | | | | |
|---|---|---|---|---|
| 2009/0014037 | A1* | 1/2009 | Richter | B08B 3/022 134/42 |
| 2012/0152410 | A1* | 6/2012 | Sikora | B21D 22/22 148/530 |
| 2012/0186705 | A1* | 7/2012 | Sikora | B21D 22/02 148/516 |
| 2012/0234069 | A1* | 9/2012 | Matsumoto | B21D 22/21 72/342.1 |
| 2013/0008568 | A1* | 1/2013 | Suwa | C21D 6/005 148/522 |
| 2014/0203482 | A1* | 7/2014 | Blumenau | C21D 9/561 266/44 |
| 2015/0052717 | A1* | 2/2015 | Noe | B21B 45/06 29/81.03 |

FOREIGN PATENT DOCUMENTS

| | | | | |
|---|---|---|---|---|
| DE | 102010043229 | A1 | 5/2012 | |
| DE | 102009015160 | A1 | 9/2019 | |
| EP | 0385561 | A1 | 9/1990 | |
| JP | 201225977 | A * | 2/2012 | |
| WO | 2010020212 | | 2/2010 | |
| WO | 20120858247 | A2 | 6/2012 | |
| WO | WO 2012152508 | A1 * | 11/2012 | C21D 9/561 |
| WO | WO 2013156316 | A1 * | 10/2013 | B21B 45/06 |

OTHER PUBLICATIONS

English translation of abstract for DE 102007012180 (B3).
English translation of abstract for DE 102010043229 (A1).

* cited by examiner

METHOD FOR THE SURFACE TREATMENT OF A WORKPIECE

FIELD

This disclosure relates to a method for the surface treatment of workpieces, in particular of coated metal workpieces, for hot forming.

BACKGROUND

Hot forming is a known and frequently used method for the plastic deformation of metal materials. In contrast with cold forming, hot forming takes place at temperatures above the recrystallization temperature of the material that is to undergo the forming, so that even very high degrees of forming can be achieved. Owing to the heating of the workpieces that is required for the hot forming, there is the risk that parts of the coating will peel away and stick to the heated workpieces as contamination. Such contaminants may damage the (pressing) tool during a subsequent hot-forming operation or reduce the surface quality and dimensional accuracy of the components produced, and should therefore be avoided.

DE 10 2007 012 180 B3 for example discloses a method for the heat treatment of semi-finished metal products in a continuous furnace. The continuous furnace described has two zones, which when looking in the direction in which the workpiece is fed through the furnace, are arranged one behind the other and which are largely separated from one another by an intermediate wall. The intermediate wall can be displaced, so that its position can be adapted to the size of the semi-finished products that are transported through the furnace. Heaters are provided in both zones of the continuous furnace, and are configured as gas burners with which different temperatures can be set in the two zones.

According to the teaching of DE 10 2007 012 180 B3, a fan may be provided on the upper side in each of the two zones by which an air stream can be generated and directed onto the semi-finished products that are located in the zone. The furnace has feed lines, with which air or an inert gas can be fed in from the outside. There are also return lines, with which gas can be drawn off out of the furnace and returned into the furnace again—that is to say recirculated. In this case, a cooling of the recirculated gas may take place. Both lines open out into the furnace in the region of the fans. Therefore, the fans and the feed and return lines mean that there are different possibilities for treating the semi-finished products. After the heated semi-finished products leave the continuous furnace, the semi-finished products are to be fed to a downstream treatment or forming process.

The solution that is known from DE 10 2007 012 180 B3 has various disadvantages. One disadvantage of the solution described is that the air stream generated by the fans always impinges on the semi-finished products perpendicularly, that is to say at an angle of approximately 90°. Other angles, on the other hand, which may for example be desirable for reasons of flow mechanics, cannot be set. Another disadvantage is that a directed pressurized jet cannot be generated by the fans, but only a turbulent air stream with a very low pressure.

SUMMARY

Disclosed herein is a method for the surface treatment of a coated metal workpiece for hot forming. In one embodiment, the method comprises at least partially heating the workpiece to a temperature of at least Ac1, cleaning at least one surface of the heated workpiece with at least one pressurized air jet, forming the heated and cleaned workpiece, and cooling down the formed workpiece.

One object of the present disclosure is to provide a method for the surface treatment of workpieces, in particular of coated metal workpieces, for hot forming, that provides an improved surface treatment of the workpieces.

BRIEF DESCRIPTION OF THE DRAWINGS

The present invention is described in detail below with reference to the attached drawing figures, wherein.

DETAILED DESCRIPTION

Figure 1:
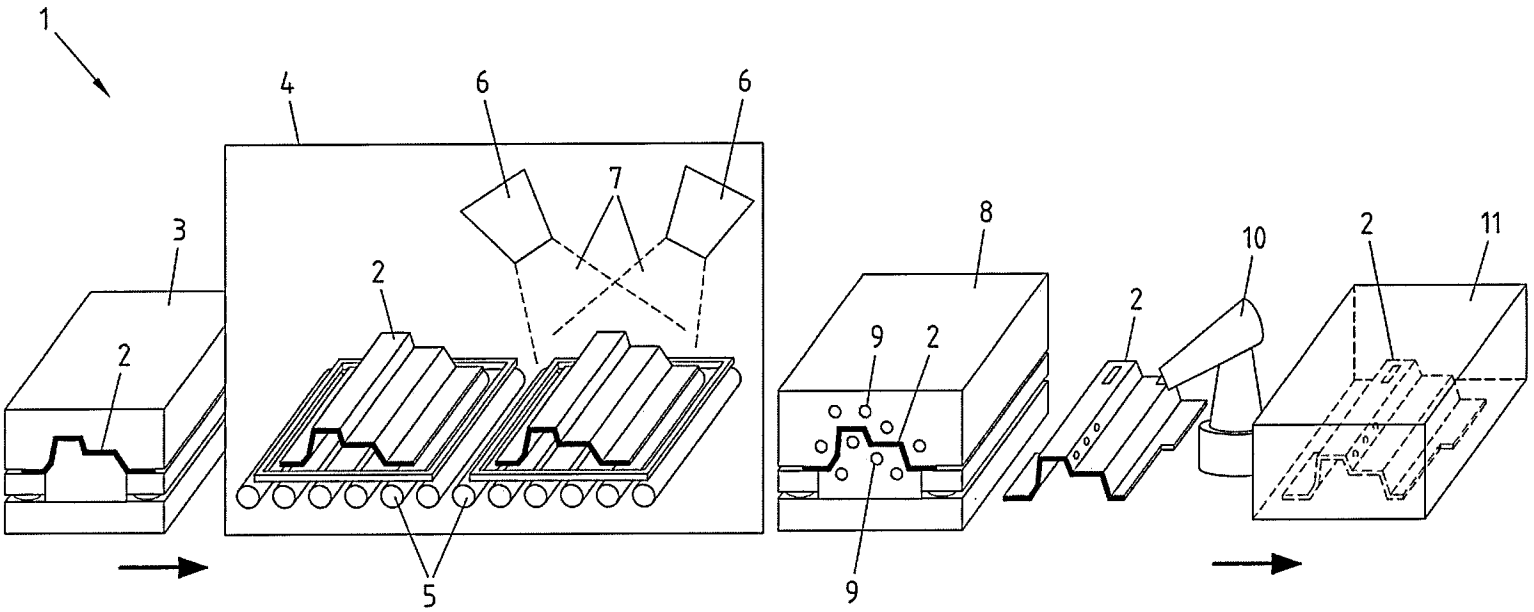
FIG. 1 is a perspective view of an embodiment of a system for performing the method of the present disclosure.

A method according to the present disclosure is a method for the surface treatment of workpieces, in particular of coated metal workpieces, for hot forming. The surface treatment of the workpieces may particularly concern the cleaning of the workpiece surface. Metal workpieces that are intended to undergo hot forming after the treatment are treated in particular. The treatment is therefore intended to serve as preparation for the hot-forming operation. The workpieces may be for example sheets or thin plates of steel, the thickness of which is less than 3.5 mm, in particular less than 2.5 mm. The workpieces may have a coating, which particularly contains zinc, aluminum or magnesium (or alloys thereof).

The method according to the invention has at least the following steps: b) partially or completely heating the workpieces to a temperature of at least Ac1; c) cleaning the workpiece surfaces of the heated workpieces with at least one pressurized air jet; d) forming the heated and cleaned workpieces; and e) cooling down the formed workpieces.

Step b) concerns the heating up of the workpieces and may take place in a furnace, for example in a roller hearth furnace or in a "batch furnace." The workpieces must be heated to a temperature above their recrystallization temperature, since a hot-forming operation can only take place in this temperature range. Depending on the nature of the material and its precise alloy composition, the recrystallization temperature differs. The workpieces should therefore be partially or completely heated to at least Ac1, preferably to at least Ac3. In the case of steels, as referred to here, Ac1 is understood as meaning that (transformation) temperature at which the formation of austenite begins during the heating. In the case of steels, Ac3 is understood as meaning that (transformation) temperature at which the transformation of ferrite into austenite ends during the heating. The cleaning of the workpiece surfaces takes place by means of a pressurized air jet. A pressurized air jet is understood as meaning any jet that contains air; however, other constituents apart from air may also be present. The pressurized air jet is preferably generated with a working or compacting pressure of at least 4 bar, in particular at least 6 bar. Preferably, each pressurized air jet also has a volumetric flow of at least 100 l/min, in particular at least 200 l/min Blasting with pressurized air has often not been used in the past because it leads to rapid cooling down of the workpieces (heat transmission by "convection"). However, the cooling down can be reduced, or prevented completely, for example by the blasting with pressurized air taking place inside a furnace and/or by air that has been heated up being used for the blasting. In this way, the temperature of the workpieces can even be increased further by the pressurized air jets. The "pressurized air spray" has the effect that the workpieces are freed of contaminants that attach themselves to the workpieces and could damage the (pressing) tool during a subsequent hot-forming operation or could reduce the surface quality and dimensional accuracy of the finished components. One reason of the contaminants is the partial detachment of coatings, for example a zinc-oxide layer or a zinc-manganese-oxide layer or aluminium-oxide layer. Following the cleaning, a hot-forming operation takes place (step d) and a cooling down (step e) of the workpieces. Steps d) and e) may take place one after the other or at the same time.

According to one form of the method, it is provided that the pressurized air jet in step c) has an angle of inclination in the range between 10° and 80°, in particular in the range between 20° and 70°. The angle of inclination is understood as meaning the angle between the surface of a planar workpiece and the central axis of the jet. Even in the case of workpieces with a surface that is not planar, the angle of inclination is understood as meaning the angle between the surface of a planar workpiece in this case imaginary—and the central axis of the jet. In the case of a roller hearth furnace, the angle of inclination therefore always corresponds—irrespective of the geometry of the workpiece—to the angle between the transporting plane of the workpieces that is formed by the rollers and the central axis of the jet. This inclination of the pressurized air jets within the specified ranges of angles achieves the effect that the contaminants are removed very thoroughly from the workpiece. An angle of inclination of 90°, on the other hand, would merely press the contaminants perpendicularly onto the workpiece surface.

A further form of the method provides that the workpiece surfaces in step c) are cleaned with multiple pressurized air jets, which have different angles of inclination. The setting of different angles of inclination allows particularly effective removal of the contaminants to be achieved. For example, the angle of inclination of a first pressurized air jet can be optimized with regard to the detachment of the contaminants from the workpiece surface, while the angle of inclination of a second pressurized air jet can be optimized with regard to blowing away the already detached contaminants from the workpiece surface. As an alternative or in addition to different angles of inclination, the pressurized air jets may also have different directions and for example be aligned laterally, in order to blow the contaminants away from the workpieces at the side.

In a further form of the method it is provided that the pressurized air jet in step c) is directed onto the workpiece surfaces at a temperature above the ambient temperature. In other words, the pressurized air jet should be heated or preheated. A heated pressurized air jet has the advantage that the already heated workpiece does not cool down to a temperature below the recrystallization temperature, because such strong cooling down would make a subsequent hot-forming operation impossible, and consequently would partially negate the previously carried out energy-intensive heating of the workpiece. The pressurized air jet is preferably directed onto the workpiece surface at a temperature that corresponds at least to the temperature to which the workpiece has been heated. Setting the temperature of the pressurized air jets above the temperature of the workpiece can even achieve the effect of heating the workpieces further.

A further teaching of the method provides that the pressurized air jet in step c) contains preheated air from a furnace intended for the heating of the workpieces. The use of already heated-up air from the furnace makes it possible to waive a separate device for heating the pressurized air jet. At the same time, it can be achieved that the pressurized air jet always has the same temperature as the interior of the furnace, and consequently also has approximately the same temperature as the workpieces heated up in the furnace. The pressurized air jet may consist exclusively of hot furnace air or have other constituents apart from the hot furnace air (for example a mixture of hot furnace air and cold ambient air).

According to a further form of the method, it is proposed that step c) is carried out in a furnace intended for the heating of the workpieces. The blasting with pressurized air inside a furnace has several advantages. One advantage is that a cooling down of the workpieces is prevented, because heating of the workpieces by the furnace can continue to take place during the blasting with pressurized air. A further advantage is that the furnace forms a completely or largely closed cocoon around the workpieces, which allows the contaminants blasted from the workpiece to be collected in an environmentally friendly and safe manner. Moreover, there is a reduced risk of fire and explosion, which presents a hazard as a result of the large surface area of the contaminants whirled up.

A further form of the method provides that the pressurized air jet in step c) is enriched with oxygen. The admixing of oxygen has the effect for example that the formation of oxides and/or nitrides can be prevented. Oxides and/or nitrides are very hard compounds, which can lead to greater abrasive damage to the pressing tools during the hot-forming operation.

A further form of the method is characterized by the following step: ca) suction of contaminants that are removed from the workpiece surfaces by the pressurized air jet in step c). The suction likewise serves the purpose of reducing the environmental and health risks. The suction may take place continuously or at specific time intervals, that is to say intermittently. In the case of a roller hearth furnace, the contaminants may preferably be collected and extracted underneath the rollers, since the contaminants gather in any case in this area due to gravitational force.

According to a further form, the method may be supplemented by the following step, which is carried out before step b): a) forming the cold workpieces. A preceding cold-forming operation has the advantage that the workpieces can already be pre-formed and only have to be slightly formed or calibrated in the hot-forming operation.

Finally, according to a further form of the method, it is provided that the coating of the workpiece contains zinc or zinc alloys. Zinc coatings offer particularly effective corrosion protection and are therefore usually used. However, individual constituents of zinc coatings may become detached from the surface of the workpieces during the heating, so that the cleaning of the workpieces by pressurized air jets is particularly advantageous in the case of zinc coatings.

The present disclosure is explained in further detail below with reference to the attached drawing figures, which represent various preferred exemplary embodiments of the present disclosure.

In FIG. 1, a first variant of an installation 1 for carrying out the method according to the invention is represented. The installation 1 comprises multiple stations, in which workpieces 2 can be worked or treated one after the other. In the case of the installation 1 that is represented in FIG. 1, the workpieces 2 are sheets or thin blanks of metal, which run through the installation 1 in the direction of the arrow. The installation 1 that is shown in FIG. 1 has as a first station a device 3 for the cold forming of the workpieces 2. The device 3 may be a press, in which the workpieces 2 are plastically deformed. In alternate embodiments, alternate cold forming processes may be incorporated with or as a substitution for the cold press disclosed above, without departing from the scope of the present disclosure. The deformed workpieces 2 then enter a furnace 4, which represents the next station of the installation 1. The furnace 4 that is shown in FIG. 1 is a roller hearth furnace, in which the already deformed workpieces 2 are transported on rolls 5 and heated up. As an alternative to a roller hearth furnace, a "batch furnace" with the workpieces 2 arranged in layers, as known for example from DE 10 2010 043 229 A1, may also be used.

Arranged inside the furnace 4 are two nozzles 6, from each of which there emerges a pressurized air jet 7, which is directed onto the already heated workpieces 2. The nozzles 6 have in each case a central axis, which is inclined with respect to a transporting plane formed by the rolls 5 by an angle of inclination α—not represented in FIG. 1. This has the consequence that the pressurized air jets 7 emerging from the nozzles 6 are likewise inclined, and consequently impinge on the workpieces 2 obliquely. After they leave the nozzles 6, the pressurized air jets 7 typically increase their cross-sectional area, whereby for example a conical form of jet with an aperture angle β—likewise not represented in FIG. 1—can be obtained. The fact that the pressurized air jets 7 impinge obliquely on the workpieces 2 means that the workpieces are cleaned effectively. Since the blasting of the workpieces 2 takes place inside the furnace 4, a cooling down of the workpieces 2 can nevertheless be prevented.

In the case of the installation 1 that is represented in FIG. 1, the next station is formed by a device 8 for the hot forming of the workpieces 2. As in the case of the device 3 for the cold forming, the device 8 for the hot forming may also be a press, between the upper side and underside of which the workpieces 2 are plastically deformed or calibrated to a slight extent. It may be provided that the device 8 for the hot forming has cooling channels 9, so that the workpieces 2 can be cooled during the hot-forming operation.

Finally, the installation 1 that is shown in FIG. 1 comprises two stations for the subsequent working or subsequent treatment of the workpieces 2. These are firstly a cutting device 10, which may for example be a laser cutting device. After the cutting to size of the workpieces 2, blasting may take place in a blasting cubicle 11, taking the form for instance of sand blasting or shot peening.

Figure 2:
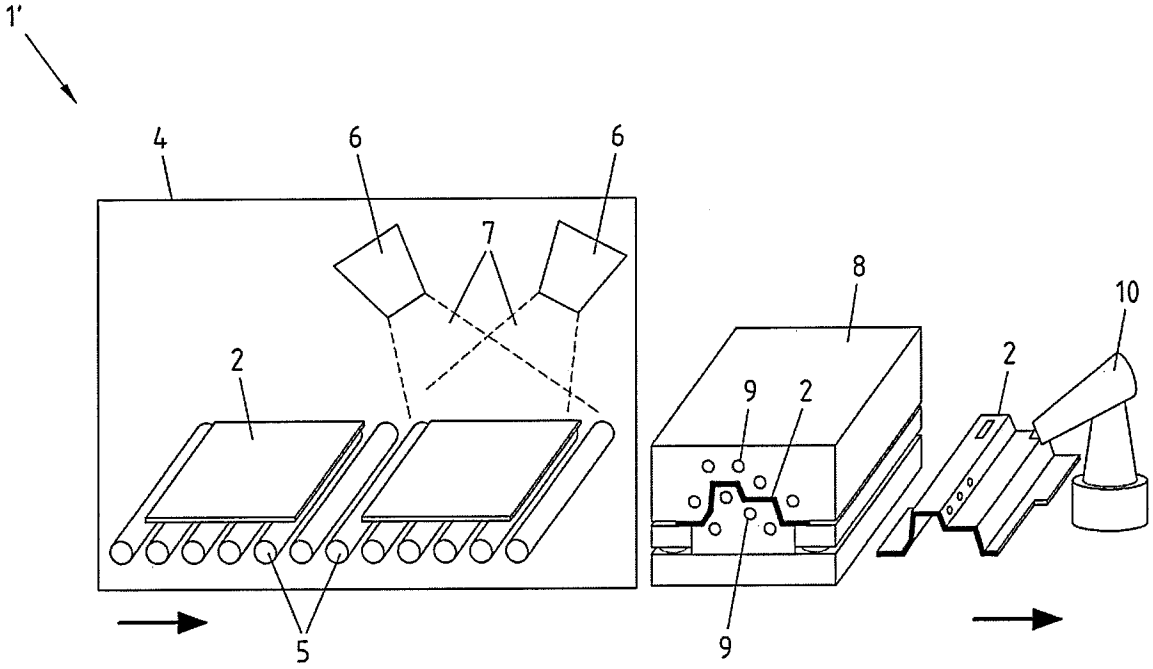
FIG. 2 is a perspective view of an alternate embodiment of a system for performing the method of the present disclosure.

FIG. 2 shows a second variant of an installation 1' for carrying out the method according to the invention. The regions of the installation 1 that have already been described in connection with FIG. 1 are provided with corresponding designations in FIG. 2. The installation 1' that is shown in FIG. 2 differs from the installation 1 that is represented in FIG. 1 particularly in that no cold forming of the workpieces 2 takes place before they enter the furnace 4. Accordingly, in the case of the installation 1', the device 3 for the cold forming has been omitted and the workpieces 2 are introduced into the furnace 4 in a still un-deformed, planar state. Both the heating and the blasting of the workpieces 2 inside the furnace 4 accordingly likewise take place in an un-deformed state. Only after they leave the furnace 4 the workpieces 2 are subjected for the first time to (hot) forming, in the device 8. The process that is represented in FIG. 2 is therefore also referred to as "direct hot forming," while the process that is shown in FIG. 1 is also referred to as "indirect hot forming." A further difference between the installation 1 from FIG. 1 and the installation 1' from FIG. 2 is that, in the case of the installation 1', the second subsequent-treatment station, that is the blasting cubicle 11, has also been omitted.

Figure 3:
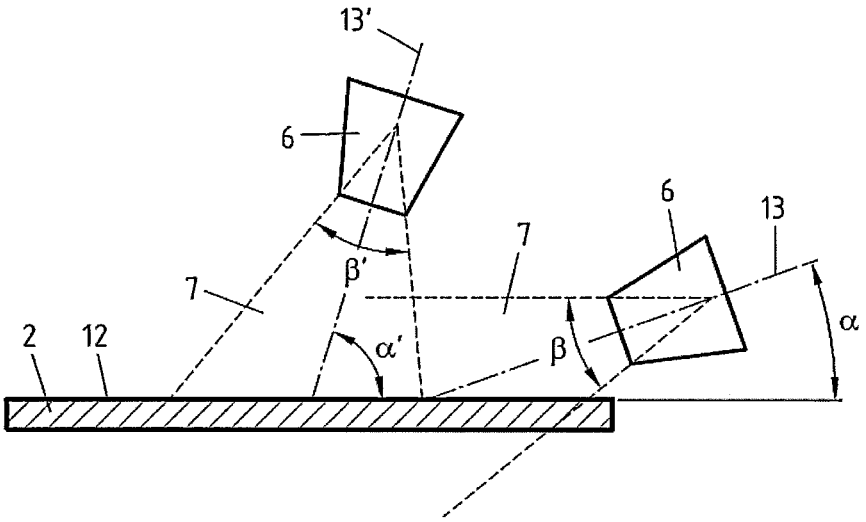
FIG. 3 is a schematic side profile view of two nozzles and two pressurized air jets used in the cleaning of a workpiece surface, according to a method of the present disclosure.

In FIG. 3, two nozzles 6 and two pressurized air jets 7 are shown in the cleaning of a workpiece surface 12. In the case of the situation that is represented in FIG. 3, the workpiece 2 is still un-deformed and therefore has a planar workpiece surface 12. The two nozzles 6 have central axes 13, 13', which are inclined with respect to the workpiece surface 12 by angles of inclination α, α'. The angles of inclination α, α' preferably lie in the range between 10° and 80° (taken from the workpiece surface 12). The two nozzles 6 that are represented in FIG. 3 are inclined to different degrees and have for example angles of inclination of α=20° and α'=70°. The inclination of the nozzles 6 has the consequence that the pressurized air jets 7 emerging from the nozzles 6 are likewise inclined, and consequently impinge on the workpiece surface 12 of the workpiece 2 obliquely. After they leave the nozzles 6, the pressurized air jets 7 that are shown in FIG. 3 increase their cross-sectional area, whereby conical or truncated conical forms of jet with aperture angles β, β' are obtained. The pressurized air jets 7 that are represented in FIG. 3 have for example aperture angles β, β' in the range between 10° and 50°.

Figure 4:
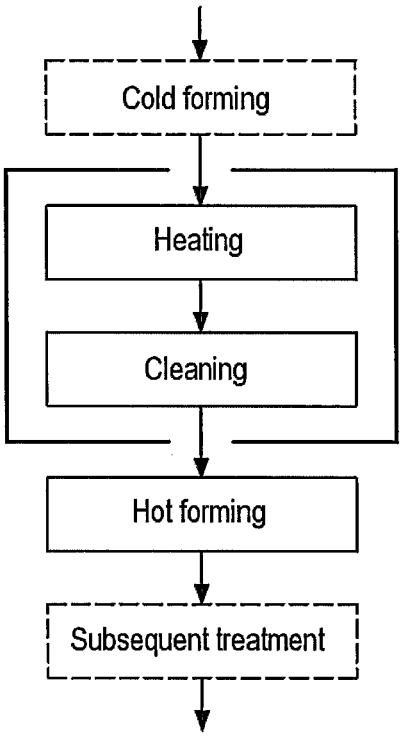
FIG. 4 is a flow chart diagram indicating an embodiment of a sequence of steps in an embodiment of the method of the present disclosure.

FIG. 4 shows the sequence of a method according to the invention in a schematic representation. Firstly, a cold forming of the workpieces 2 to be treated takes place. This is understood as meaning a forming operation at a temperature below the recrystallization temperature (often at room temperature). The cold forming is merely optional and may also be omitted (represented in FIG. 4 by a frame indicated by dashed lines). In the next step, the workpieces 2 to be treated are heated. The partial or complete heating preferably takes place to a temperature well above Ac1 or Ac3, in order to prepare the workpieces 2 for a subsequent hot-forming operation. After the partial or complete heating, a cleaning of the workpiece surface 12 takes place with a pressurized air jet 7. The pressurized air jet 7 allows contaminants to be removed from the surface 12. Both the heating and the cleaning preferably take place in a furnace 4, for example a roller hearth furnace. After the cleaning, the hot forming takes place. Since the surfaces 12 of the workpieces 2 have previously been cleaned, contaminants and damage thereby caused to the forming tool are ruled out. During and/or after the hot forming, a cooling down of the workpieces 2 takes place—not represented in FIG. 4. After the hot forming, a subsequent treatment of the workpieces 2 may finally take place. This may for example be a cutting to size or blasting (for example sand blasting, shot peening) of the workpieces 2. The subsequent treatment is also merely optional, and may therefore be omitted (represented in FIG. 4 by a frame indicated by dashed lines).

What is claimed is:

1. A method for the surface treatment of a metal blank for hot forming, comprising:

at least partially heating the blank to a temperature of at least Ac1; immediately following the at least partially heating, cleaning at least one surface of the heated blank by directing at least one pressurized air jet onto the at least one surface of the heated blank, wherein each of the at least one pressurized air jet has a working pressure of at least 4 bar, and a volumetric flow rate of at least 100 l/min; immediately following the cleaning, forming the heated and cleaned blank in a press to obtain a formed workpiece; and cooling down the formed workpiece, wherein a subsequent treatment of blasting the formed workpiece takes place after said cooling of the formed workpiece.

2. The method of claim 1, wherein the at least one pressurized air jet has an angle of inclination of between 10° and 80°.

3. The method of claim 1, wherein said cleaning step includes cleaning the at least one surface of the blank with a plurality of pressurized air jets having different angles of inclination.

4. The method of claim 1, wherein said cleaning step further includes blowing air, having a temperature above ambient air temperature, from the at least one pressurized air jet onto the blank surfaces.

5. The method of claim 4, wherein said cleaning step further includes, prior to blowing the air from the air jet onto the blank surfaces, preheating the air to be blown onto the blank by a furnace to be used for heating the blank.

6. The method of claim 1, wherein said cleaning step is performed in a furnace used to heat the blank.

7. The method of claim 1, wherein the pressurized air jet is enriched with oxygen.

8. The method of claim 1, further comprising:

suctioning away contaminants that are removed from the blank surface by the pressurized air jet.

9. The method of claim 1, wherein the blank has a coating that contains at least one of zinc, a zinc alloy, aluminum, and an aluminum alloy.

10. The method of claim 1, wherein after said cooling of the formed workpiece a further subsequent treatment of the formed workpiece takes place and the formed workpiece is cut to size.

11. A method for the surface treatment of a coated metal sheet or blank for hot forming, comprising:

at least partially heating the coated sheet or blank to a temperature of at least Ac1, wherein a coating of the coated sheet or blank includes at least one of zinc, a zinc alloy, aluminum, and an aluminum alloy; immediately following the at least partially heating, cleaning at least one surface of the heated coated sheet or blank by directing at least one pressurized air jet onto the at least one surface of the heated coated sheet or blank, wherein said cleaning includes removing contaminants due to partial detachment of a zinc-oxide-layer or an aluminum-oxide-layer; immediately following the cleaning, forming the heated, cleaned, and coated sheet or blank in a press to obtain a formed workpiece; and cooling down the formed workpiece.

12. The method of claim 11, wherein said cooling takes place while forming the heated, cleaned, and coated sheet or blank in the press.

13. The method of claim 11, wherein said at least partially heating takes place in a roller hearth furnace or batch furnace.

14. A method for the surface treatment of a coated pre-formed metal workpiece for hot forming, comprising:

providing a coated metal sheet or blank, wherein a coating of the coated metal sheet or blank includes at least one of zinc, a zinc alloy, aluminum, and an aluminum alloy;

cold forming the coated metal sheet or blank in a press to obtain coated pre-formed metal workpiece at least partially heating the coated pre-formed metal workpiece to a temperature of at least Ac1; immediately following the at least partially heating, cleaning at least one surface of the heated coated pre-formed metal workpiece by directing at least one pressurized air jet onto the at least one surface of the heated coated pre-formed metal workpiece, wherein said cleaning includes removing contaminants due to partial detachment of a zinc-oxide-layer or an aluminum-oxide-layer; immediately following the cleaning, plastically deforming the heated, cleaned, and coated pre-formed metal workpiece in a second press to obtain a formed workpiece; and cooling down the formed workpiece.

15. The method of claim 14, wherein said cooling takes place while plastically deforming the formed workpiece in the second press.

16. The method of claim 14, wherein said at least partially heating takes place in a roller hearth furnace or batch furnace.

* * * * *